US006872026B2

(12) United States Patent
Petner

(10) Patent No.: US 6,872,026 B2
(45) Date of Patent: Mar. 29, 2005

(54) HANDLE CONNECTOR

(75) Inventor: Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 10/408,822

(22) Filed: Apr. 4, 2003

(65) Prior Publication Data

US 2004/0197133 A1 Oct. 7, 2004

(51) Int. Cl.[7] ..... B25G 3/24

(52) U.S. Cl. ..... 403/379.3; 403/378; 15/145; 15/171; 15/176.6

(58) Field of Search ..... 403/294, 306, 403/315–317, 320, 324, 376–378, 379.2, 379.3; 15/143.1, 144.1, 144.2, 145, 146, 171, 175, 176.1, 176.6

(56) References Cited

U.S. PATENT DOCUMENTS

| | | | | | |
|---|---|---|---|---|---|
| 1,681,011 | A | * | 8/1928 | Robinson, Jr. | 15/143.1 |
| 1,794,048 | A | * | 2/1931 | Wright | 15/145 X |
| 1,947,697 | A | * | 2/1934 | Cohen | 15/145 X |
| 1,956,142 | A | * | 4/1934 | Brohasek et al. | 15/171 X |
| 1,983,923 | A | * | 12/1934 | Stevens et al. | 15/146 X |
| 2,680,868 | A | * | 6/1954 | Peterson | 15/144.2 X |
| 2,710,981 | A | * | 6/1955 | Steiert | 15/176.1 X |
| 2,725,585 | A | * | 12/1955 | Vosbikian et al. | 15/145 X |
| 2,755,495 | A | * | 7/1956 | Park | 15/144.2 |
| 2,883,689 | A | * | 4/1959 | Vosbikian et al. | 15/145 X |
| 2,895,152 | A | * | 7/1959 | Vosbikian et al. | 15/145 X |
| 3,012,264 | A | * | 12/1961 | Nash | 15/144.2 X |
| 3,420,581 | A | * | 1/1969 | Richardson | 15/143.1 X |
| 3,858,266 | A | * | 1/1975 | Thomas | 15/146 |
| 5,603,583 | A | * | 2/1997 | Jackson | 403/320 |
| 5,930,863 | A | * | 8/1999 | Samuelsson | 15/144.1 X |
| 6,349,444 | B1 | * | 2/2002 | Sander | 15/146 |

FOREIGN PATENT DOCUMENTS

| | | | | | |
|---|---|---|---|---|---|
| DE | 2548352 | A1 | * | 5/1977 | B25G/3/24 |
| ES | 2014847 | A | * | 7/1990 | A47L/13/24 |
| FR | 2325470 | A | * | 5/1977 | B25G/3/24 |
| FR | 2367209 | A | * | 6/1978 | B25G/3/26 |
| FR | 2456594 | A | * | 1/1981 | A01B/1/02 |

* cited by examiner

*Primary Examiner*—Daniel P. Stodola
*Assistant Examiner*—Ryan M. Flandro
(74) *Attorney, Agent, or Firm*—Stuart M. Goldstein

(57) ABSTRACT

A handle connector for securing the head of a cleaning tool to its handle is formed as a unitary integral body, preferably of die-cast construction. The connector has two distal ends. At one end, there is an opening for receiving a handle. The other end of the connector extends outwardly and is configured to mate with the head of a broom, mop, or similar manual tool. The body of the connector includes a floating web comprising a substantially flat section and laterally flanking slots. A bolt and wing nut are provided for joining the handle to the connector. As the wing nut is manually tightened against the connector, it applies a compressive force against the flat section of web, which flexes inward in relation to the handle, ultimately contacting the outside surface of the handle. Continued manual tightening ensures for a tight fit between handle and connector and rigidly secures the joint between these tool components.

7 Claims, 3 Drawing Sheets

HANDLE CONNECTOR

BACKGROUND OF THE INVENTION

This invention relates to the connection of a handle to the head of a broom, mop, or other similar manually operated tool. There have been numerous means employed to accomplish this seemingly simple objective; however, only a very limited number of connection systems have succeeded in accomplishing an integral, permanently tight fit between handle and head—especially during prolonged use of the tool.

For instance, handles with tapered ends often use tapered sleeves into which the tapered ends are fitted. The sleeve is then inserted into an opening in the head and secured to the head. Such a sleeve, however, often cracks or breaks—resulting in the handle coming loose from the head. Some handles with non-tapered ends have threaded connections which threadingly mate with their heads. It is difficult to keep these connections from loosening during use. In such cases, an extra component, such as a locking bracket, is used to maintain the handle in position. Another common handle connector is configured as a type of connector sleeve to be secured at one end to its head, and which may accept a handle at its other end. However, it is generally difficult to permanently and rigidly secure a handle, especially a non-tapered one, with this type of connector. There is insufficient connector-to-handle contact, which results in movement of the handle within the connector. The common practice of merely joining a handle to a connector by screws or other means, usually results in a less than secure connection. Typically the connection is loose or becomes loose during use, again resulting in annoying movement between connector and handle.

SUMMARY OF THE INVENTION

It is thus an object of the present invention to overcome the disadvantages and limitations of prior handle connectors.

It is an object of the present invention to provide a handle connector of die-cast construction which is a unitary, integral body.

It is a further object of the present invention to provide a handle connector which easily receives and maintains a handle securely to the head.

It is still another object of the present invention to provide a handle connector which employs a floating web section, which, with the application of appropriate compressive force, ensures a tight fit between handle and connector—to maintain the integrity of the joint between these elements.

It is still a further object of the present invention to provide a handle connector which is easily fabricated and simply and efficiently installed between handle and head.

It is another object of the present invention to provide a handle connector which allows a direct and tight handle to head connection, especially for non-tapered handles.

These and other objects of the invention are accomplished by the handle connector of the present invention which is formed as a unitary integral body, preferably of die-cast construction. The connector has two distal ends. At one end, there is an opening for receiving a handle. The other end of the connector extends outwardly and is configured to mate with the head of a broom, mop, or similar manual tool. The body of the connector includes a floating web comprising a substantially flat section and laterally flanking slots. A bolt and wing nut are provided for joining the handle to the connector. As the wing nut is manually tightened against the connector, it applies a compressive force against the flat section of web, which flexes inward in relation to the handle, ultimately contacting the outside surface of the handle. Continued manual tightening ensures for a tight fit between handle and connector and rigidly secures the joint between these tool components.

Novel features which are considered as characteristic of the invention are set forth in particular in the appended claims. The invention itself, both as to its design, construction and use, together with the additional features and advantages thereof, are best understood upon review of the following detailed description with reference to the accompanying drawings.

DETAILED DESCRIPTION OF THE INVENTION

Figure 1:
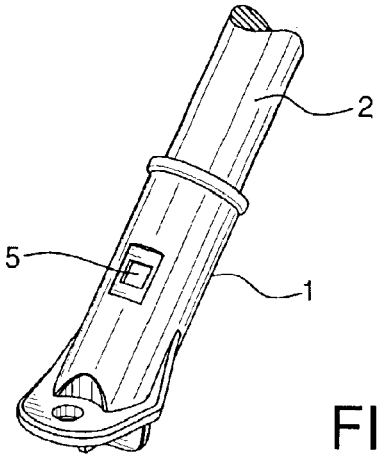
FIG. 1 is an isometric view of the connector of the present invention, with a partial view of an inserted handle.
Figure 2:
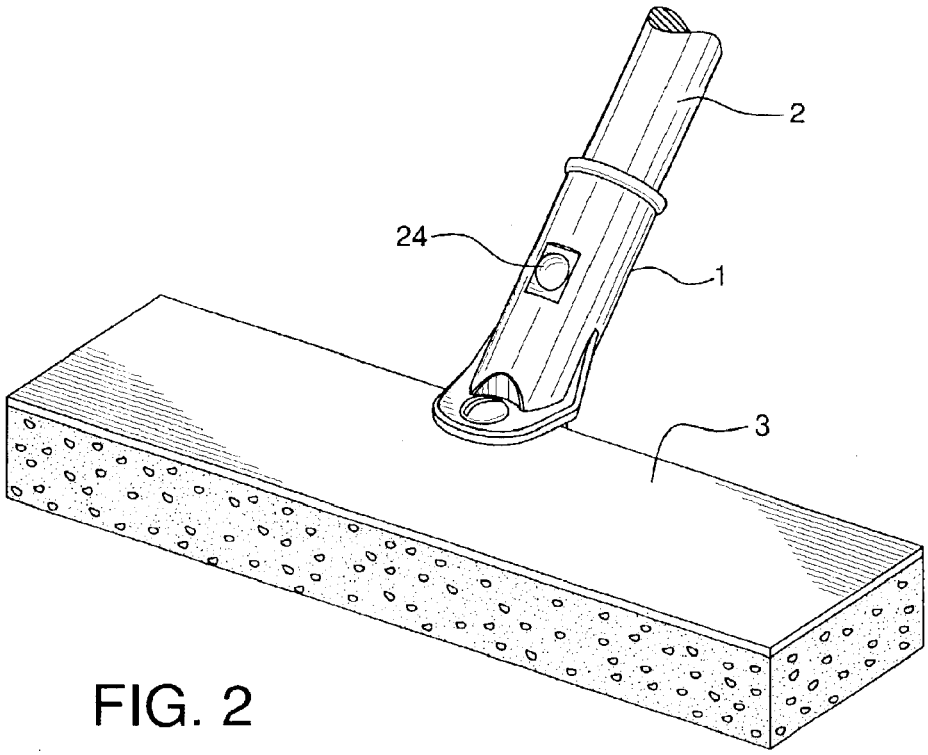
FIG. 2 is an isometric view of the connector of the present invention, shown in place and secured to a handle and tool head.
Figure 3:
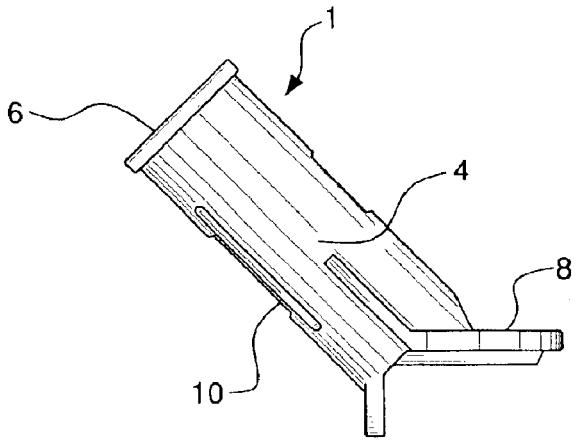
FIG. 3 is a side view of the connector of the present invention.
Figure 4:
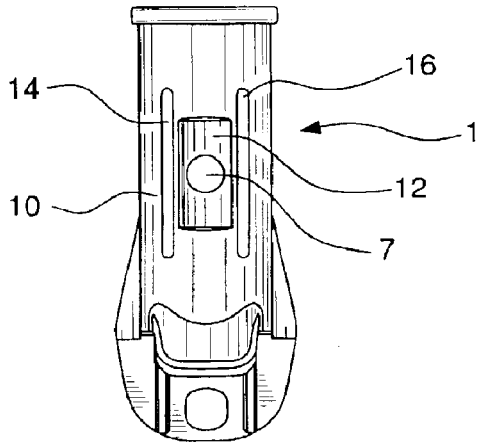
FIG. 4 is a rear view of the connector of the present invention.
Figure 5:
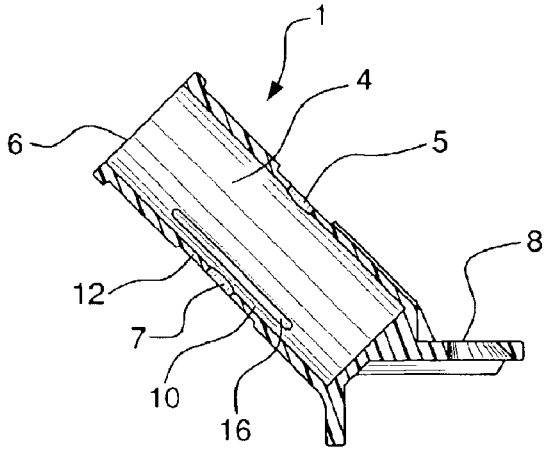
FIG. 5 is a cross-sectional side view of the connector of the present invention.
Figure 6:
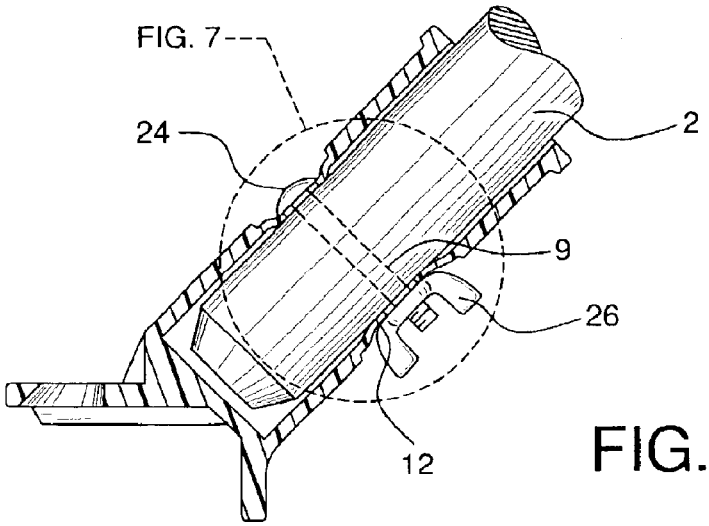
FIG. 6 is a cross-section side view of the connector of the present invention, secured to a handle.

Connector 1 is formed as an integral, unitary body, optimally of die-cast construction. It is substantially cylindrical in configuration to accept handle 2. Connector 1 has a central section 4 and distal ends 6 and 8. End 6 is open to receive the end of handle 2. The other end 8 of connector 1 comprises an extension which extends outwardly and is configured to mate with head 3 of a broom, mop, or other manual tool. Openings 5 and 7 are configured to receive an attachment device, such as bolt 24, for securing handle 2 via connector 1 to head 3.

Connector 1 further comprises, at central section 4, floating web section 10 which includes substantially flat section 12 on the outer surface of the connector, slots 14 and 16 which laterally flank section 12, and opening 5. Opening 5 is in alignment with opening 7 and is located on the front, outer surface of connector 1, opposite flat section 12. Web section 10 is formed so as to allow flexure of connector 1 at flat section 12, when a compressive force is placed on flat section 12. Slots 14 and 16, advantageously flanking flat section 12, assist in providing resilient, flexibility at this location.

Figure 7:
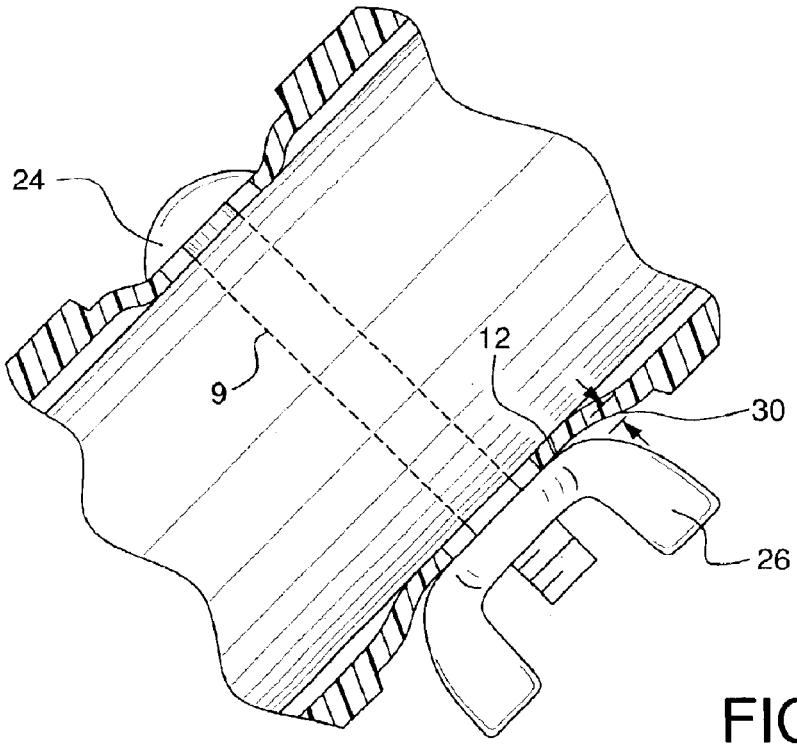
FIG. 7 is a close-up, cross-section side view of the connector of the present invention, secured to a handle.

In use, handle 2 is position within connector 1, such that a throughhole 9 of handle 2 is aligned with openings 5 and 7 of the connector. Bolt 24 is inserted through connector 1 and hole 9 of handle 2. As wing nut 26 is manually tightened, a compressive force is applied against flat section 12 of web section 10, flat section 12 flexes inward a given distance 30 in relation to handle 2, ultimately contacting the outside surface of the handle, as seen in FIG. 7. Continued manual tightening of wing nut 26 not only provides a stronger more rigid connection by means of the bolt and nut attachment, but also, most importantly, the increased surface to surface contact between flat section 12 and handle 2 ensures that there is a tight fit between handle and connector and that the integrity of the joint between these components is maintained.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

I claim:

1. A handle connector for joining the handle of a manually operated tool to the head of the tool, said handle having an outer surface, and the connector being formed as an integral, unitary body with a substantially cylindrical surface and distal ends, said connector being in spaced apart relation to and substantially surrounding the outer surface of the handle and further comprising:

opening means at one distal end for receiving the handle at that distal end;

attachment means at the other distal end for securing the connector to the head of the tool; and web means located between the distal ends for maintaining the integrity of the joint between the handle and the connector, said web means comprising a substantially flat web section indented within the substantially cylindrical surface of the connector, said substantially flat web section flexing inwardly, to directly contact the outer surface of the handle upon application of a compressive force from a means to secure the connector to the handle.

2. The handle connector as in claim 1 wherein the flat web section is substantially rectangular in configuration.

3. The handle connector as in claim 2 wherein the web means further comprises slots extending substantially laterally of the flat web section.

4. The handle connector as in claim 1, wherein the means to secure the connector to the handle comprises a bolt and corresponding nut, the bolt extending through the handle and the connector, whereby tightening of the nut results in a compressive force at the flat web section, resulting in flexure of the flat web section towards the handle and increased integrity of the joint between the handle and the connector.

5. The handle connector as in claim 2 wherein the means to secure the connector to the handle comprises a bolt and corresponding nut, the bolt extending through the handle and the connector, whereby tightening of the nut produces a compressive force at the flat web section, resulting in flexure of the flat web Section towards the handle and increased integrity of the joint between the handle and the connector.

6. The handle connector as in claim 1 wherein the attachment means comprises an integrally formed extension of the connector configured for mating placement with the head.

7. The handle connector as in claim 5 wherein the attachment means comprises an integrally formed extension of the connector configured for mating placement with the head.

* * * * *